United States Patent [19]

Omichi

[11] Patent Number: 4,519,538

[45] Date of Patent: May 28, 1985

[54] PACKING AND DISPLAYING CARTON, AND BLANK PLATE THEREFOR

[76] Inventor: Namio Omichi, 5-29-12, Hongo, Bunkyo-ku, Tokyo, Japan

[21] Appl. No.: 620,600

[22] Filed: Jun. 14, 1984

[30] Foreign Application Priority Data

Aug. 12, 1983 [JP] Japan ..... 58-124502[U]

[51] Int. Cl.[3] ..... B65D 5/48

[52] U.S. Cl. ..... 229/27; 229/28 BC; 229/15; 206/427; 206/44 R

[58] Field of Search ..... 229/27, 28 R, 28 BC, 229/15; 206/427, 44 R

[56] References Cited

U.S. PATENT DOCUMENTS

| | | | |
|---|---|---|---|
| 2,111,621 | 3/1938 | Gerking et al. | 229/27 |
| 2,665,048 | 1/1954 | Belsinger | 229/27 |
| 2,706,037 | 4/1955 | Feigelman | 229/27 |
| 2,808,177 | 10/1957 | Buttery | 229/27 |
| 2,850,223 | 9/1958 | Strauss | 229/27 |
| 3,092,301 | 6/1963 | Selle | 229/27 |
| 3,785,545 | 1/1974 | Roussel | 229/27 |
| 4,039,117 | 8/1977 | Sieffert | 229/27 |
| 4,377,237 | 3/1983 | Pawlowski | 229/27 |

*Primary Examiner*—Joseph Man-Fu Moy

*Attorney, Agent, or Firm*—Armstrong, Nikaido, Marmelstein & Kubovcik

[57] ABSTRACT

A packing and displaying carton as well as a blank plate for election thereof, said carton having two neighboring compartments to independently or commonly accommodate goods therein and a double walled partition for the compartments, which partition serves as a reinforcement for a bottom and side panels of the carton, when said carton is used for transportation and reservation of the goods and provides a displaying window for the goods, when said carton is divided along a double wall of the partition into two separate displaying units.

5 Claims, 7 Drawing Figures

PACKING AND DISPLAYING CARTON, AND BLANK PLATE THEREFOR

BACKGROUND OF THE INVENTION

1. Field of the Invention

The present invention relates to a packing and displaying carton as well as a blank plate therefor, which has two neighboring compartments to independently or commonly accommodate therein various goods such as bottled, canned or carton packed products and has a double walled partition for the compartments. The carton can be divided along neighboring walls of the partition into two separate units, each accommodating therein the product to display the same.

2. Prior Arts

A most widely used packing carton at the present has been made of a corrugated cardboard, having four side panels as well as upper and lower panels which are connected respectively to an upper and lower sides of each of said side panels, folded inwardly to overlap one another and fixed with use of an adhesive, staples or the like to form a top and bottom panels of the carton, respectively.

For modifying such a conventional packing carton into one serving also to display a good accommodated therein, it necessary to provide in at least one side panel of the carton with an area surrounded by a scored or perforated line and to be broken out to form a displaying window for the good. It is preferable to make the area as large as possible for forming a larger window to increase an effect of displaying the good but this greatly reduce a strength or rigidity of the carton per se, due to the score line therefor. In order to avoid the disadvantage, a special reinforcing member is required, which increase a material and assembling costs of the carton. While, a formation of such window on the conventional packing carton with no score line requires a troublesome manual cutting operation.

Thomas D. Pawlowski discloses in his U.S. Pat. No. 4,377,237 a multiple compartment carton which accommodates two or more goods, separately in tandemly arranged compartments or units. According to the carton, one unit may be opened and removed from the carton without damage to a remaining unit which has a panel defined by weakened lines and opposing to the unit as removed. This carton is directed to an accommodation of individual servings of food and is not suitable for displaying the good accommodated therein.

SUMMARY OF THE INVENTION

An object of the present invention is to provide a packing and displaying carton which has two neighboring compartments to independently or commonly accommodate various goods therein and a double walled partition for the compartment, which partition serves not only as a reinforcement to allow an accommodation of a relatively heavy good in the carton for its transportation and reservation but also a member for providing a displaying window, when the carton is divided along a double wall of the partition into two separate units for displaying the goods.

According to the invention, such an object can be attained by a packing and displaying carton with two neighboring compartments, which comprises a front panel connected to one side of a first bottom panel; a first pair of two side panels, each connected to remaining opposite sides of said front panel and connected to remaining opposite sides of said first bottom panel; a rear panel connected to one side of a second bottom panel; a second pair of two side panels, each connected to remaining opposite sides of said rear panel and connected to remaining opposite sides of said second bottom panel; a first reinforcing panel, one side thereof being connected to a remaining side of said first bottom panel and opposite sides being connected to remaining side of each side panel for said first pair; and a second reinforcing panel, one side thereof being connected to a remaining last side of said first reinforcing panel, another side opposing to the first side being connected to a remaining side of said second bottom panel, and remaining two sides being connected to remaining side of each side panel for said second pair; said reinforcing panels being connected each other with a weakened line and having an area surrounded by another weakened line.

Another object of the present invention is to provide a blank plate suitable for election into such a packing and displaying carton.

According to one of aspects of the invention, such an object can be attained by a blank plate which consists of a first section and a second section connected by central two folding lines to said first section and divided from said first section by a cut line formed between the central folding lines, each of said sections comprising a front or rear panel, a half section of both side panels connected to opposite sides of said front or rear panel, and a half section of a bottom panel connected to a remaining side of said front or rear panel; each half section of said side panel having a flap at a side opposing to the side connected to said front or rear panel and corresponding flaps in each of said first and second sections being made contact with each other to serve as a reinforcing and partitioning member, when said first and second sections are turned by folding same along said central folding lines for election of said blank plate into a carton.

It is preferable that each half section of said side panel has another flap at a remaining side opposing to the cut line side, which is to be folded along the side to reinforce the bottom panel. It is also preferable that each half section of said side panel has an area surrounded by a weakened line and a folding line, which is to be turned to hold the reinforcing and partitioning flap when the blank plate is elected into the carton.

According to another aspect of the invention, the latter object can also be attained by a blank plate which consists of a first section and a second section connected by a central folding line to said first section, each of said sections comprising tandemly arranged panels of a first side panel, a reinforcing panel connected to a side of said first side panel, a second side panel connected to a side of said reinforcing panel and a front or rear panel connected to a side of said second side panel; at least one of said tandemly arranged panels having at a side opposing to the central folding line a flap as a bottom panel and each of said reinforcing panels having an area surrounded by a weakened line and said central folding line, which is to be removed when said blank plate is elected into a carton for displaying a good accommodated therein.

DETAILED DESCRIPTION OF THE ILLUSTRATED EMBODIMENTS

Figure 1:
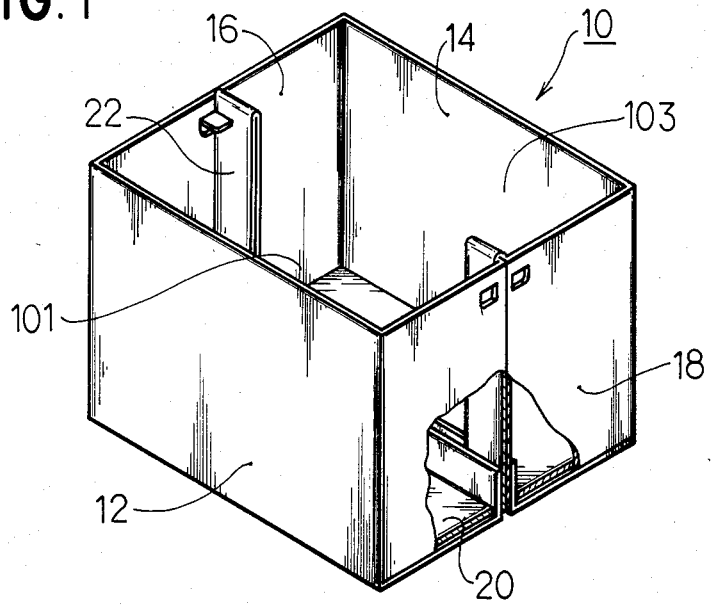
FIG. 1 is a perspective view showing an embodiment of a packing and displaying carton according to the present invention, a part thereof being cut-off.

In FIG. 1, a first embodiment of packing and displaying carton according to the present invention is designated by a reference numeral 10. The carton 10 comprises four side panels 12, 14, 16 and 18, a bottom panel 20 as well as a flange like partition 22 which is arranged to divide an inner space of the carton into two compartments 101, 103. The partition 22 has a double walled structure to reinforce the carton 10.

Figure 2:
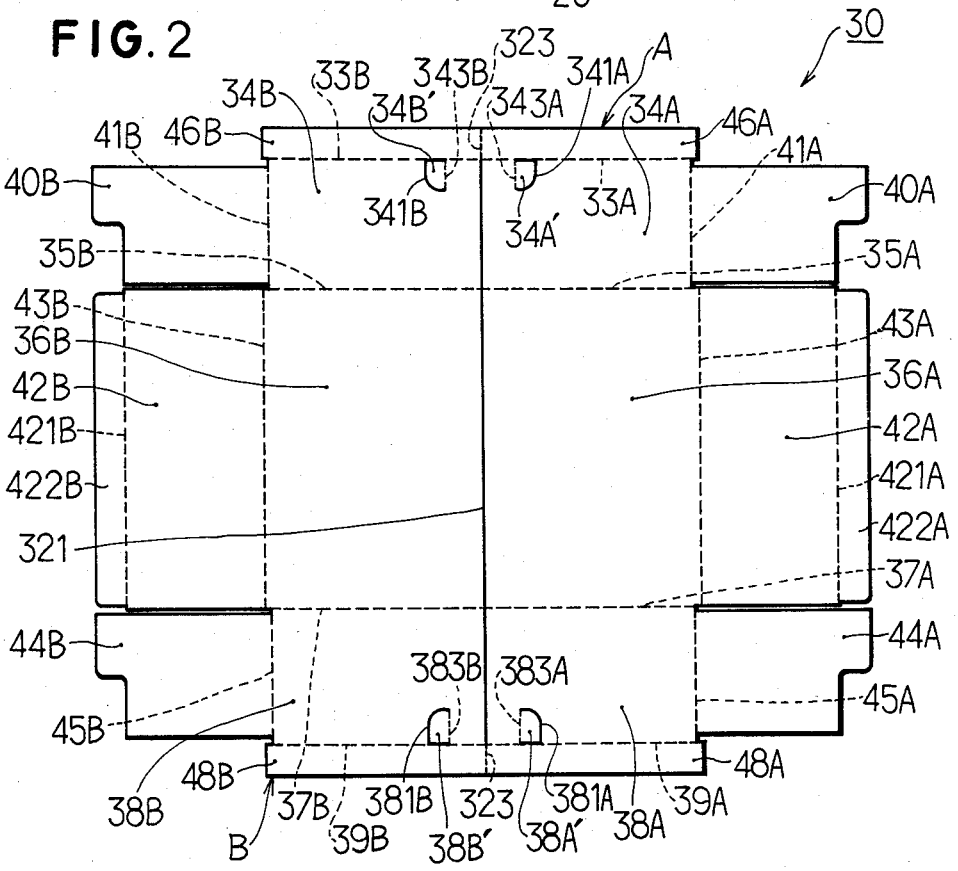
FIG. 2 is a plan view of a blank plate for the carton as shown in FIG. 1.

The carton 10 can be assembled from a single blank plate 30 as shown in FIG. 2, which may be obtained by stamping a cardboard, corrugated cardboard, or a synthetic thin plate. The blank plate 30 consists of two sections A and B which have a symmetrical configuration with each other about a line 32 formed by a central cut line 321 and scored or the like weakened lines 323, 323 extending from each end of the central cut line.

The sections A and B are same and thus the section A shall be explained. The section A comprises a first panel 34A, a second panel 36A connected to the first panel 34A through a folding line 35A, and a third panel 38A connected to the second panel 36A through a folding line 37A. The panels 34A, 36A and 38A have flaps 40A, 42A and 44A, respectively at a side opposing to the central line 32 through folding lines 41A, 43A and 45A, respectively. The flaps 42A serves as a bottom panel and has an area 422A to be turned through a folding line 421A. The other flaps 40A and 44A serve as panels for reinforcing the bottom panel, as being explained later. The panels 34A and 38A have other flaps 46A and 48A, respectively, connected through folding lines 33A and 39A at sides opposing to the folding lines 35A and 37A, respectively. The flaps 46A and 48A serve as the partition 22, when the blank plate 30 is elected into the carton 10 (FIG. 1). Each of the panels 34A and 38A have areas 34A' and 38A', respectively, surrounded by cut lines 341A and 381A as well as folding lines 343A and 383A, respectively.

One of manners for electing the blank plate 30 as shown in FIG. 2 into the carton 10 as shown in FIG. 1 will now be explained. In the first place, the panels 34A and 34B as well as panels 38A and 38B are turned inwardly along the folding lines 35A, 35B and 37A, 37B, respectively by about a right angle to the panels 36A and 36B. Then the flaps 40A, 40B and 44A, 44B are turned inwardly along the folding lines 41A, 41B and 45A, 45B respectively by about a right angle to the turned panels 34A, 34B and 38A, 38B, respectively. Thereafter, the flaps 42A and 42B are turned inwardly along the folding lines 43A and 43B, respectively by about a right angle to the panels 36A and 36B, so that the flaps 42A and 42B are overlapped on the turned flaps 40A, 44A and 40B, 44B, respectively. Further, the areas or flaps 422A and 422B are turned inwardly along folding lines 421A and 421B, respectively by about a right angle. The areas or small flaps 34A', 38A' and 34B', 38B' are turned inwardly along the folding lines 343A, 383A and 343B, 383B, respectively. Then the flaps 46A, 48A and 46B, 48B are turned inwardly along folding lines 33A, 39A and 33B, 39B, respectively by about a right angle, and portions thereof overlapping with the flaps 422A and 422B are glued one another to the latter flaps with use of an adhesive. The resulting semi-finished carton has only one compartment therein with a central slit corresponding to the central cut line 321. A half section of the semifinished carton is turned along the weakened lines 323, 323 over 180° toward the other half section, until the flaps 46A, 48A come contact with the flaps 46B, 48B, respectively, so that the blank plate 30 as shown in FIG. 2 is elected into the carton 10 as shown in FIG. 1. Please note that the small flaps 34A', 34B' as well as 38A', 38B' clamp the contacting flaps 46A, 46B as well as 48A, 48B, respectively, as shown in FIG. 1.

Figure 3:
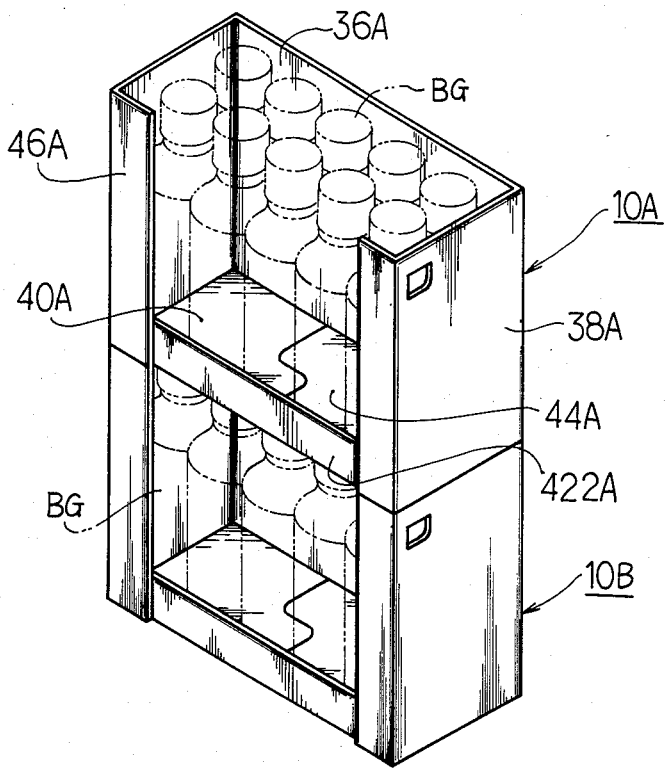
FIG. 3 is a perspective view showing one of displaying manners of goods accommodated in units which are formed by dividing the carton as shown in FIG. 1.

The carton 10 as shown in FIG. 1 can be separated into two independent containers suitable for displaying goods accommodated therein, by cutting or breaking the weakened lines 323, 323. Such containers 10A and 10B are shown in FIG. 3, which accommodate bottled goods BG and are piled up.

Figure 4:
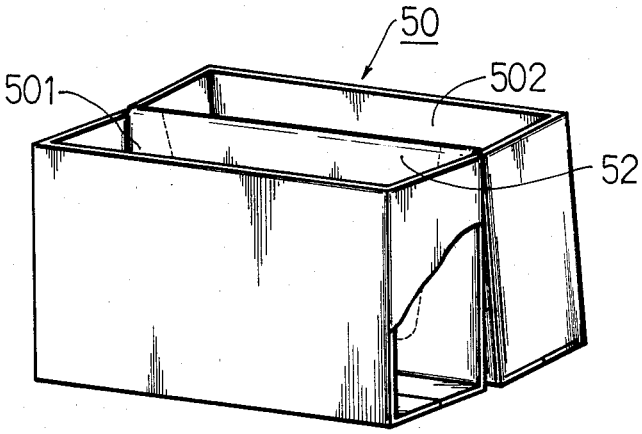
FIG. 4 is a perspective view showing another embodiment of a packing and displaying carton according to the present invention, a part thereof being cut-off.

FIG. 4 illustrates another embodiment of packing and displaying carton according to the present invention. The carton generally designated by a reference numeral 50 has two compartments 501, 502 which are separated by a double walled partition 52.

Figure 5:
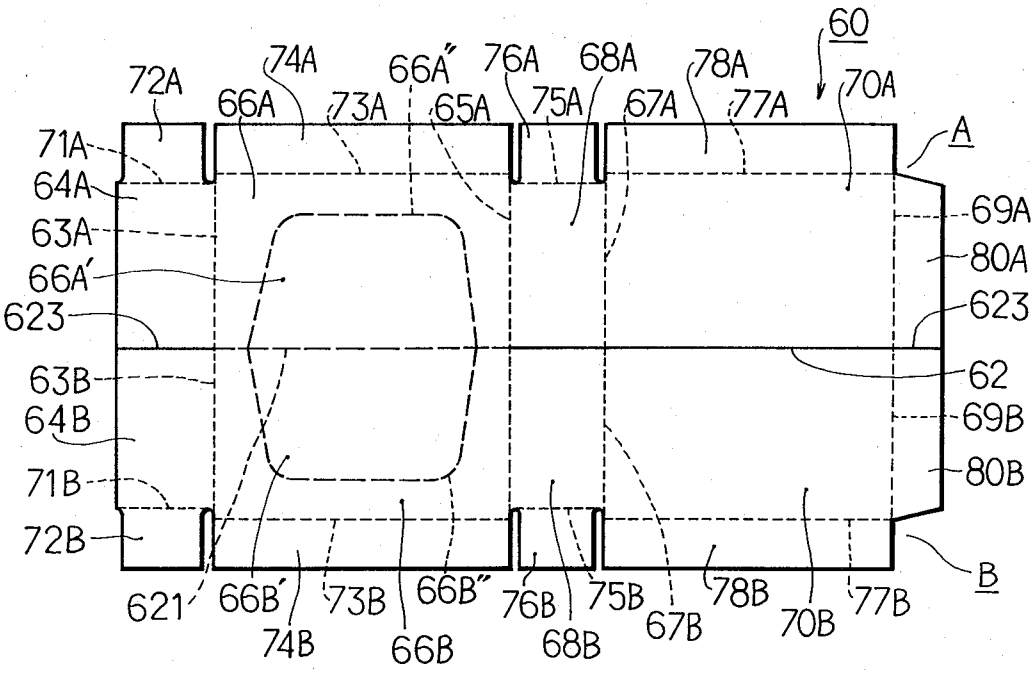
FIG. 5 is a plan view of a blank plate for the carton as shown in FIG. 1.

The carton 50 can be assembled from a single blank plate 60 as shown in FIG. 5, which may be obtained by stamping a cardboard, corrugated cardboard or a synthetic thin plate. The blank plate 60 consists of two sections A and B which have a symmetrical configuration with each other about a central line 62 formed by a central scored or the like weakened line 621 and cut lines 623, 623 extending from each end of the weakened line 621. The line 62 may entirely be formed by a weakened line.

For the sake of simplicity, following explanation shall be given as to the section A only. The section A comprises a first panel 64A as a first side member, a second panel 66A as a partition member, a third panel 68A as a second side member, and fourth panel 70A as a front or rear member, said panels being connected through folding lines 63A, 65A and 67A, respectively. The panels 64A, 66A, 68A and 70A have flaps 72A, 74A, 76A and 78A, respectively at a side opposing to the central line 62 through folding lines 71A, 73A, 75A and 77A, respectively. The flaps 72A, 74A, 76A and 78A serve as a bottom member or bottom reinforcing member. The panel 70A has another flap 80A through a folding line 69A opposing to the folding line 67A, which flap serves as a glue one to be adhered to the first panel 64A and thus a corresponding flap may be connected to the first panel 64A, in lieu of the flap 80A. The second or partition panel 66A has a relatively large area 66A' surrounded by a weakened line 66A'' and the central weakened line 621, so that the area 66A' may be removed, if necessary.

One of manners for electing the blank plate 60 as shown in FIG. 5 into the carton 50 as shown in FIG. 4 will be explained as follows. In the first place, the section A of the blank plate 60 is turned inwardly to come contact with the section B. The panels 64A and 64B are turned outwardly along the folding lines 63A and 63B, respectively by a right angle to each of the partition panel 66A or 66B. Then the panels 68A, 70A and 68B, 70B are turned outwardly by a right angle through folding lines 65A, 67A and 65B, 67B, respectively. Thereafter flaps 80A and 80B are turned outwardly by a right angle through the folding lines 69A and 69B respectively and an outer surface of each flaps 80A, 80B are glued to adhere the same to a reverse side of the first side panels 64A, 64B, respectively. While, flaps 72A, 76A and 72B, 76B are turned outwardly by a right angle through the folding lines 71A, 75A and 71B, 75B and are glued on each outer surface thereof. The other flaps 74A, 78A and 74B, 78B are also turned outwardly by a right angle through the folding lines 73A, 77A and 73B, 77B, respectively and each inner surface thereof and adhered with the glued flaps 72A, 76A and 72B, 76B to form the carton 50 as shown in FIG. 4.

The carton 50 may be separated two small containers having the compartments 501, 502, respectively by breaking down the weakened line 621 in FIG. 5. Each of the container can be served for displaying goods accommodated therein and in this case, the areas 66A', 66B' will be removed by breaking down the weakened lines 66A", 66B".

Figure 6:
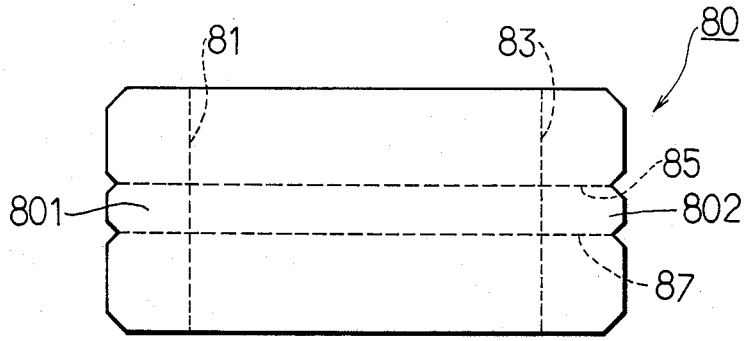
FIG. 6 is a plan view of a lid plate to be adapted to the cartons as shown in FIGS. 1 and 4.
Figure 7:
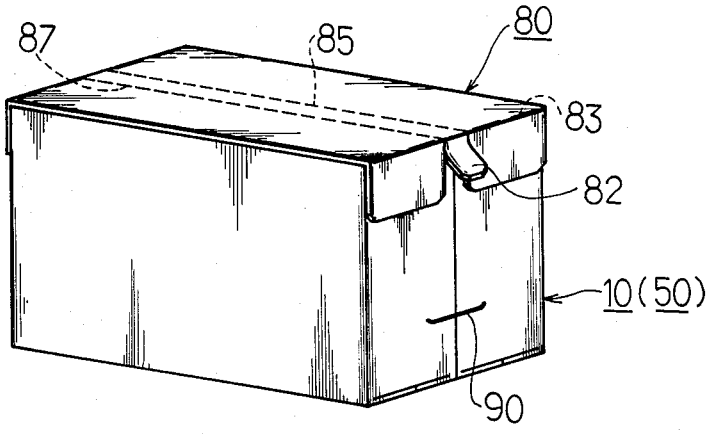
FIG. 7 is a perspective view of a container, wherein the lid plate as shown in FIG. 6 is applied for the carton as shown in FIG. 1 or 4.

The cartons 10, 50 as shown in FIGS. 1 and 4 have an opening at a top side thereof. The opening may be covered with a lid member. One of the lid members is shown in FIG. 6. The lid member 80 has various weakened lines 81, 83, 85 and 87 for easy opening the carton. The area surrounded by the weakened lines 81 and 83 which also serve as folding lines corresponds to a sectional area of the opening. Other area of the lid member 80 may be glued to adhere with the surrounding panels of the carton 10 or 50, as shown in FIG. 7. As particularly shown in FIG. 7, at least one of areas 801, 802 defined by the weakened lines 85, 87 as well as the weakened line 81 or 83 serves as a tab 82 for easily initializing an opening operation. A pull-up operation of the tab causes a breaking down on the weakened lines 85, 87, so that an operator can easily break down the other weakened lines 81, 83 to fully access in the carton 10 or 50.

According to the container of the invention, a lower portion of each units tends to go away from each other but this may be avoided by fixing the same with a staple 90, adhesive tape or the like.

The goods accommodated in the carton according to the invention can be forwarded under a packing type as shown in FIG. 7 but, if necessary the tab 82 is pulled up to break down a lid area defined by the weakened lines 85, 87 and then each compartment units are separated each other by breaking down the weakened lines 323, 323 (FIG. 2) or 621 (FIG. 5), so that a forwarding amount of the goods can be reduced in half.

Of course, each compartment unit can be used for displaying the goods, as explained with reference to FIG. 3.

I claim:

1. A packing and displaying carton with two neighboring compartments, which comprises a front panel connected to one side of a first bottom panel; a first pair of two side panels, each connected to remaining opposite sides of said front panel and connected to remaining opposite sides of said first bottom panel; a rear panel connected to one side of a second bottom panel; a second pair of two side panels, each connected to remaining opposite sides of said rear panel and connected to remaining opposite sides of said second bottom panel; a first reinforcing panel, one side thereof being connected to a remaining side of said first bottom panel and opposite sides being connected to remaining side of each side panel for said first pair; and a second reinforcing panel, one side thereof being connected to a remaining last side of said first reinforcing panel, another side opposing to the first side being connected to a remaining side of said second bottom panel, and remaining two sides being connected to remaining side of each side panel for said second pair; said reinforcing panels being connected each other with a weakened line and having an area surrounded by another weakened line.

2. A blank plate suitable for election into a packing and displaying carton with two neighboring compartments, which consists of a first section and a second section connected by central two folding lines to said first section and divided from said first section by a cut line formed between the central folding lines, each of said sections comprising a front or rear panel, a half section of both side panels connected to opposite sides of said front or rear panel, and a half section of a bottom panel connected to a remaining side of said front or rear panel; each half section of said side panel having a flap at a side opposing to the side connected to said front or rear panel and corresponding flaps in each of said first and second sections being made contact with each other to serve as a reinforcing and partitioning member, when said first and second sections are turned by folding same along said central folding lines for election of said blank plate into a carton.

3. The blank plate as claimed in claim 2, wherein each half section of said side panel has another flap at a remaining side opposing to the cut line side, which is to be folded along the side to reinforce the bottom panel.

4. The blank plate as claimed in claim 2 or 3, wherein each half section of said side panel has an area surrounded by a weakened line and a folding line, which is to be turned to hold the reinforcing and partitioning flap when the blank is elected into the carton.

5. A packing and displaying carton as claimed in claim 1 wherein said box has a lid dimensioned to cover the top of said box, with end flaps on at least two opposite margins of the central panel of said lid to fold down and cover portions of at least two panels of said box, said central panel of said lid having two spaced weakened lines extending across said lid panel to provide a tear strip to enable opening of said box.

* * * * *